US009829261B2

(12) United States Patent
Shaskan

(10) Patent No.: US 9,829,261 B2
(45) Date of Patent: Nov. 28, 2017

(54) MAGAZINE CARRIER

(71) Applicant: Torrent Loading Systems, LLC, Lynchburg, VA (US)

(72) Inventor: Paul Joseph Shaskan, Lynchburg, VA (US)

(73) Assignee: Torrent Loading Systems, LLC, Lynchburg, VA (US)

( * ) Notice: Subject to any disclaimer, the term of this patent is extended or adjusted under 35 U.S.C. 154(b) by 0 days.

(21) Appl. No.: 15/255,690

(22) Filed: Sep. 2, 2016

(65) Prior Publication Data

US 2016/0370137 A1 Dec. 22, 2016

Related U.S. Application Data

(63) Continuation of application No. 14/573,570, filed on Dec. 17, 2014, now Pat. No. 9,459,062.

(60) Provisional application No. 61/918,465, filed on Dec. 19, 2013.

(51) Int. Cl.

| | |
|---|---|
| ***F41A 9/65*** | (2006.01) |
| ***F42B 39/26*** | (2006.01) |
| ***F42B 39/02*** | (2006.01) |

(52) U.S. Cl.
CPC ..... *F41A 9/65* (2013.01); *F42B 39/02* (2013.01); *F42B 39/26* (2013.01)

(58) Field of Classification Search
CPC ..... F42B 39/002; F42B 39/26; F42B 99/00; F41A 9/65; A47F 1/126
USPC ..... 89/33.1, 45, 1.1; 42/49.02, 90, 106; 221/280
See application file for complete search history.

(56) References Cited

U.S. PATENT DOCUMENTS 9,459,062 B2 * 10/2016 Shaskan ..... F41A 9/65

* cited by examiner

*Primary Examiner* — Bret Hayes
(74) *Attorney, Agent, or Firm* — John M. Hammond; Patent Innovations LLC

(57) ABSTRACT

A magazine dispenser for loading a magazine into a gun having an opening to receive and hold at least one magazine through an opening. Once at least one magazine is inserted, a flange of the magazine is received in a track provided by a slot region in the magazine dispenser. The magazine then rests on a retention bar disposed in the track which may impede the magazine from being dispensed or support the magazine to be dispensed from the magazine dispenser depending on circumstances.

19 Claims, 14 Drawing Sheets

MAGAZINE CARRIER

CROSS-REFERENCE TO RELATED APPLICATIONS

This application is a continuation of copending U.S. patent application Ser. No. 14/573,570, filed on Dec. 17, 2014, which claims the benefit of U.S. Provisional Application No. 61/918,465, filed Dec. 19, 2013, entitled "Magazine Carrier," both of which are hereby incorporated by reference in their entireties.

The present disclosure relates to an apparatus for dispensing a magazine. The magazine may be inserted into the apparatus and be dispensed, and loaded into a gun.

BRIEF DESCRIPTION OF THE DRAWINGS

The present disclosure will become apparent and more readily appreciated from the following description of embodiments, taken in conjunction with the accompanying drawings, of which.

DETAILED DESCRIPTION OF EMBODIMENTS

Figure 1:
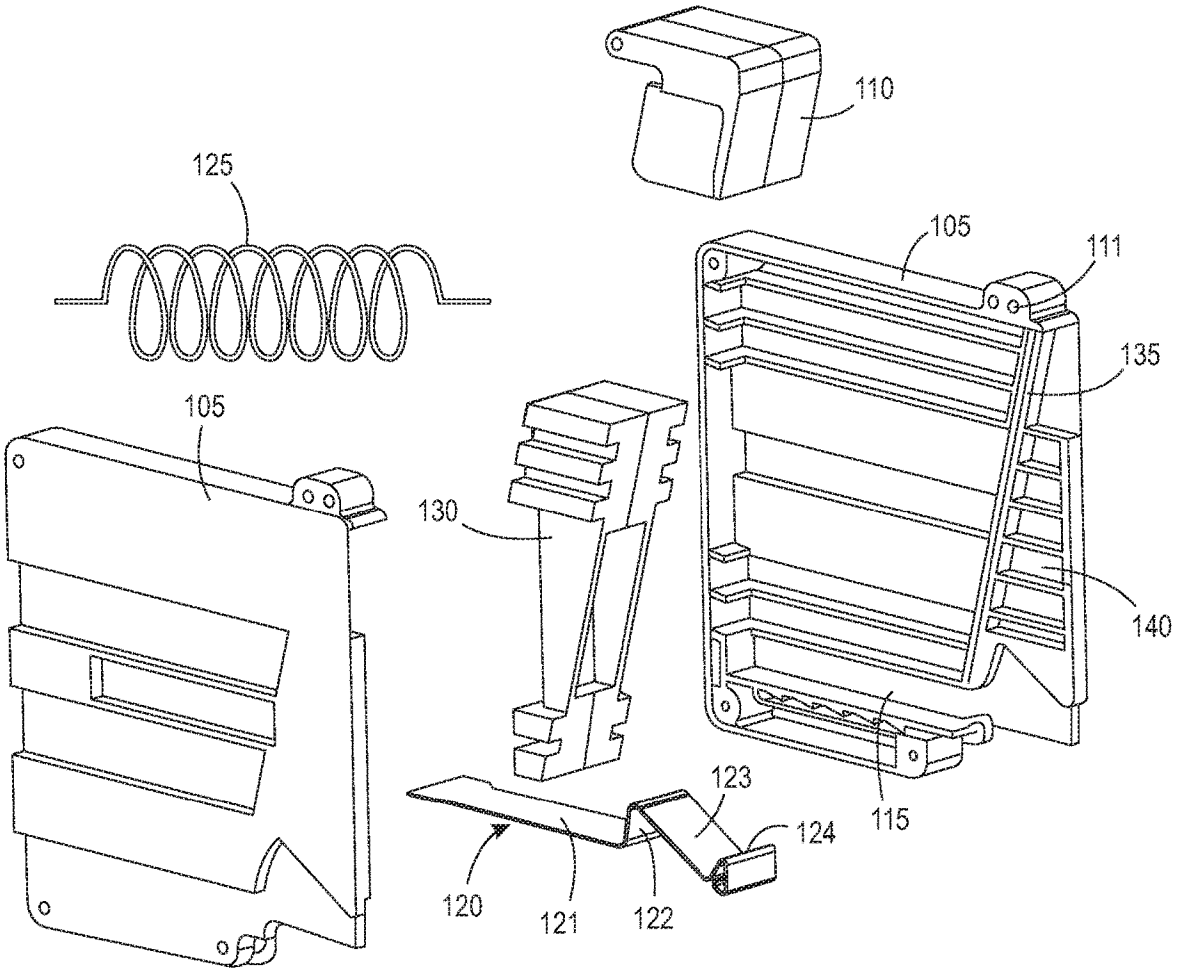
FIG. 1 is an exploded view of a magazine dispenser.

Reference will now be made in detail to embodiments of the present disclosure, examples of which are illustrated in the accompanying drawings, wherein like reference numerals refer to like elements throughout.

Referring to FIG. 1, the magazine dispenser may include housing 105, cap 110, slot region 115, retention bar 120, spring 125, and plunger 130. In accordance with at least one embodiment, slot region 115, retention bar 120, spring 125, and plunger 130 may be disposed inside of housing 105, and cap 110 may be coupled to an exterior of housing 105. Furthermore, housing 105 may be disassembled to expose its internals.

Figure 2:
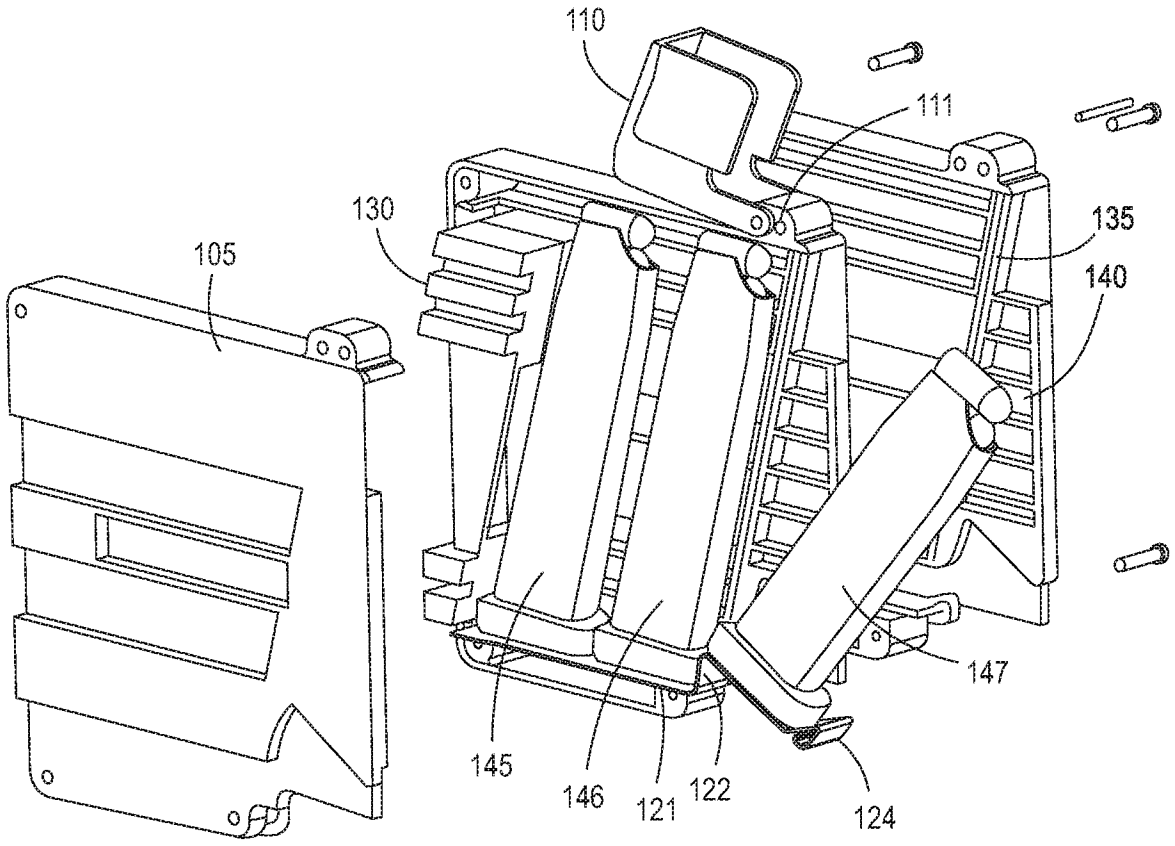
FIG. 2 is an exploded perspective view of a magazine dispenser.

As shown in FIG. 2, housing 105 may have an opening configured to receive at least one magazine. Housing 105 may include brushes 135 near the opening to prevent external dust from coming inside, and grooves 140 near the opening to provide a grip for a magazine which is about to be dispensed from housing 105. In accordance with at least one embodiment, housing 105 may be made from materials suitable for making military/law enforcement applications. For example, housing 105 may be made from Nylon 12 for military applications or Nylon 6 for law enforcement applications. In accordance with another embodiment, housing

105 may be made from plastic materials, such as carbon plastic. The present disclosure, however, is not limited thereto.

As shown in FIG. 2, housing 105 may receive and hold three magazines. First magazine 145 may be farthest away from the opening of housing 105, third magazine 147 may be closest to the opening of housing 105, and second magazine 146 may rest between first magazine 145 and third magazine 147.

Figure 3:
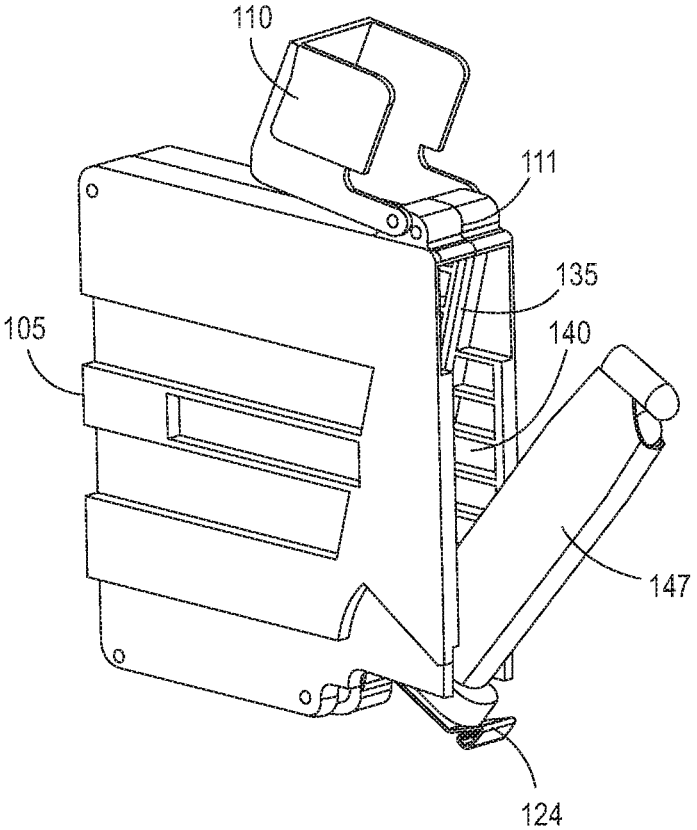
FIG. 3 is a perspective view of a magazine dispenser with a cap opened.

As shown in FIG. 3, cap 110 may be pivotally coupled to the exterior of housing 105 near the opening. Cap 110 may be pivotally coupled to an exterior of housing 105 via securing means 111. For example, securing means 111 may include a screw, a pin, a spring, a knob, and a notch. The present disclosure, however, is not limited thereto.

Figure 4A:
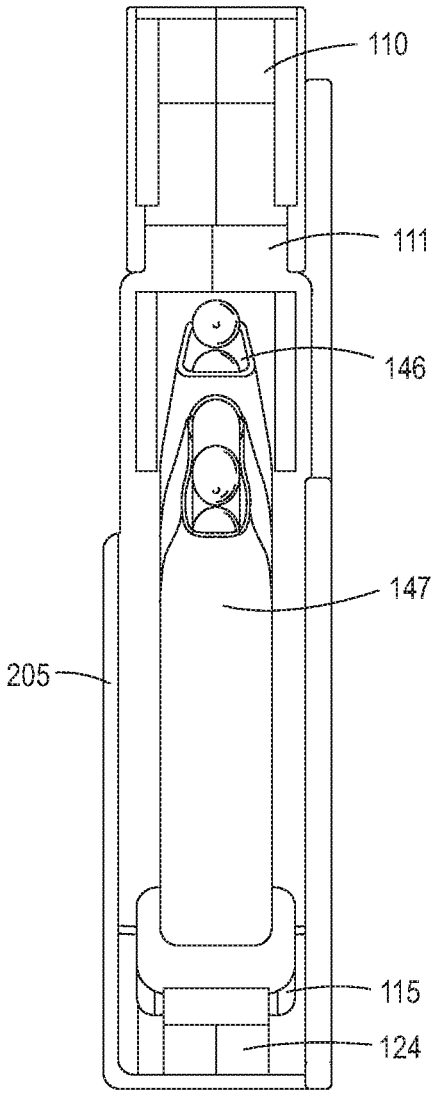
FIGS. 4A and 4B illustrates open and closed positions of a cap.
Figure 4B:
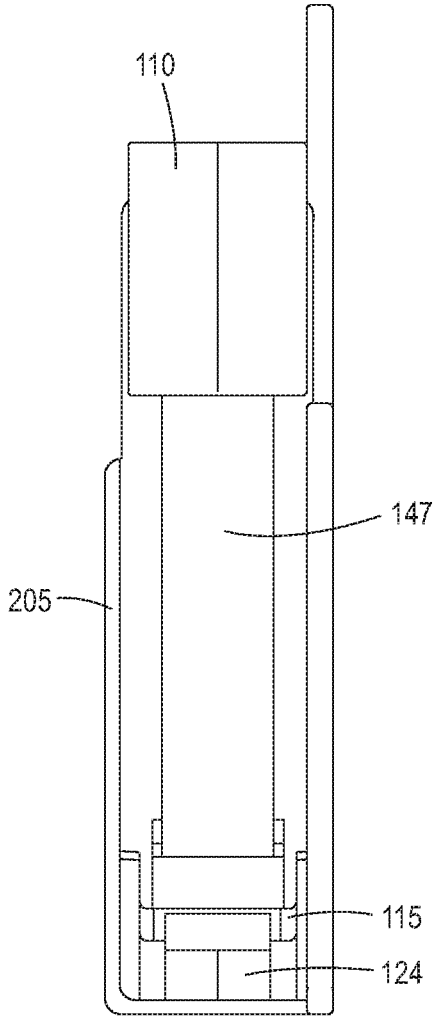

Cap 110 may have open and closed positions. As shown in FIG. 4A, cap 110 may be opened to expose magazines inserted in housing 105. When cap 110 is opened, the magazines inserted in housing 105 may be dispensed. Alternately, cap 110 may be closed to secure magazines inserted in housing 105, as shown in FIG. 4B. When cap 110 is closed, the magazines inserted in housing 105 may be secured from being accidentally dispensed from housing 105.

Figure 5:
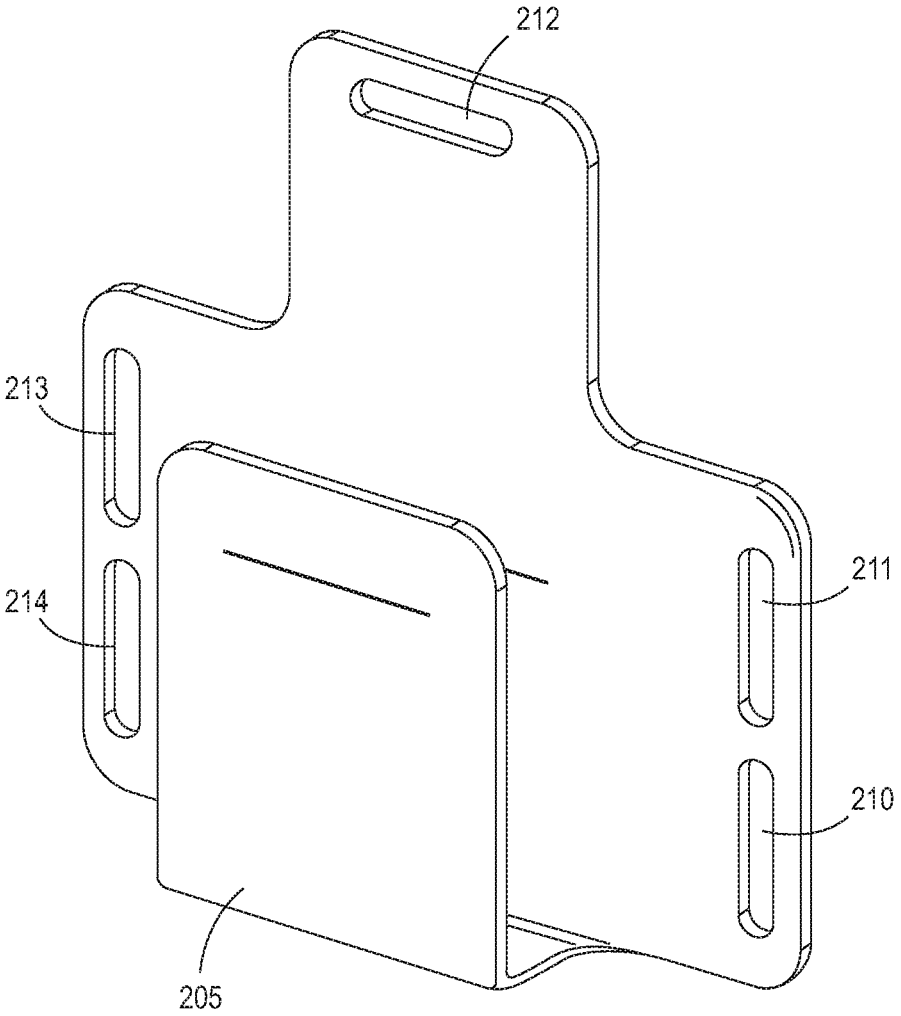
FIG. 5 is a perspective view of a holster.
Figure 6:
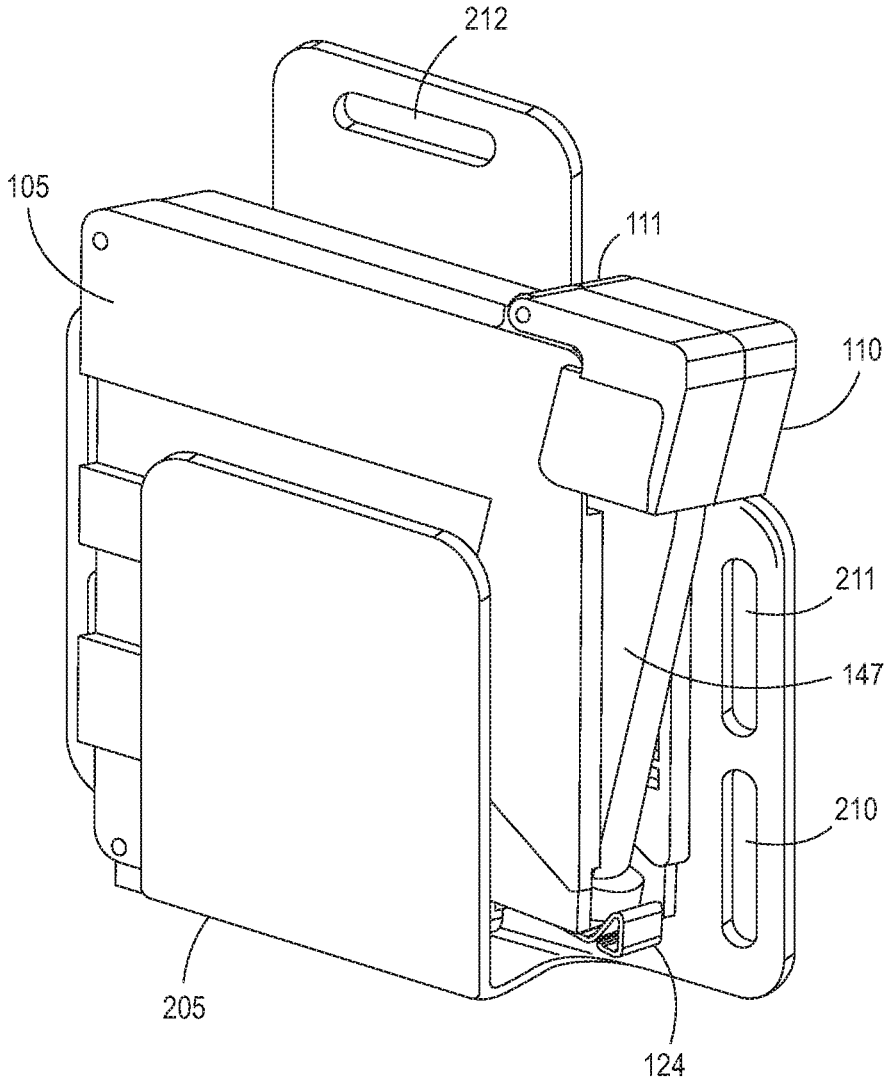
FIG. 6 is a perspective view of a magazine dispenser inserted in a holster.
Figure 7:
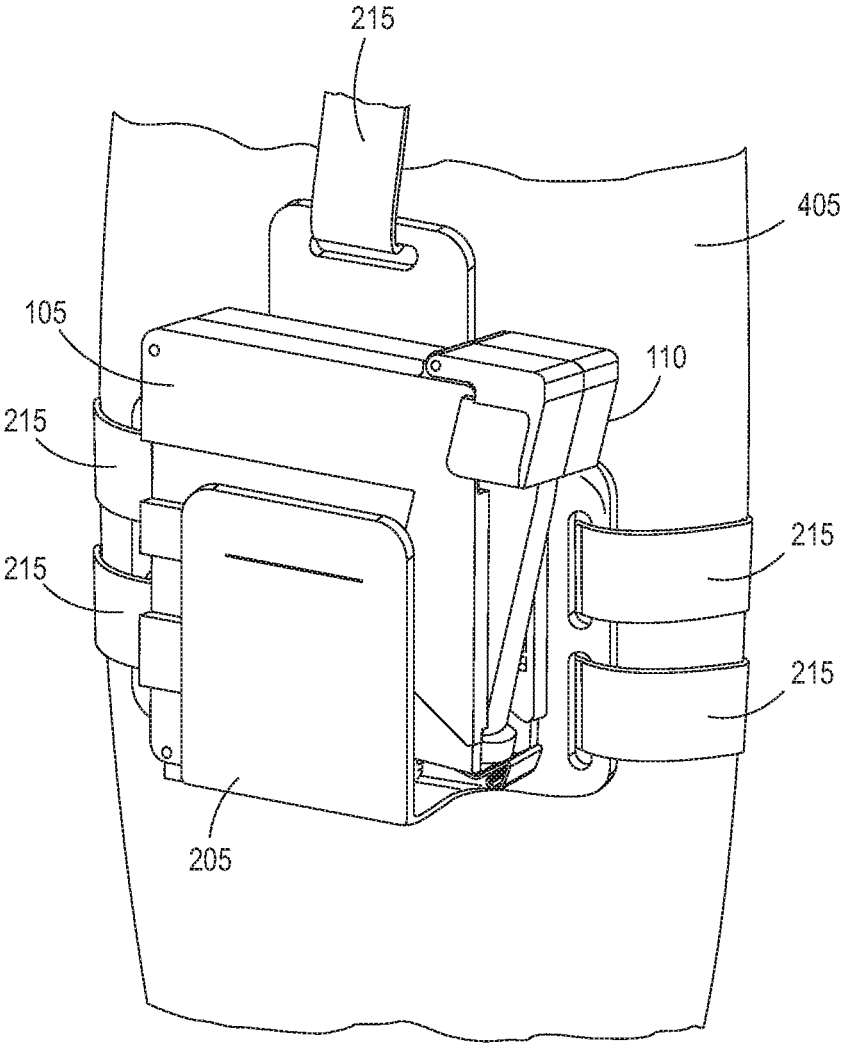
FIG. 7 is a perspective view of a magazine dispenser inserted in a holster secured on a wearer's leg.
Figure 8:
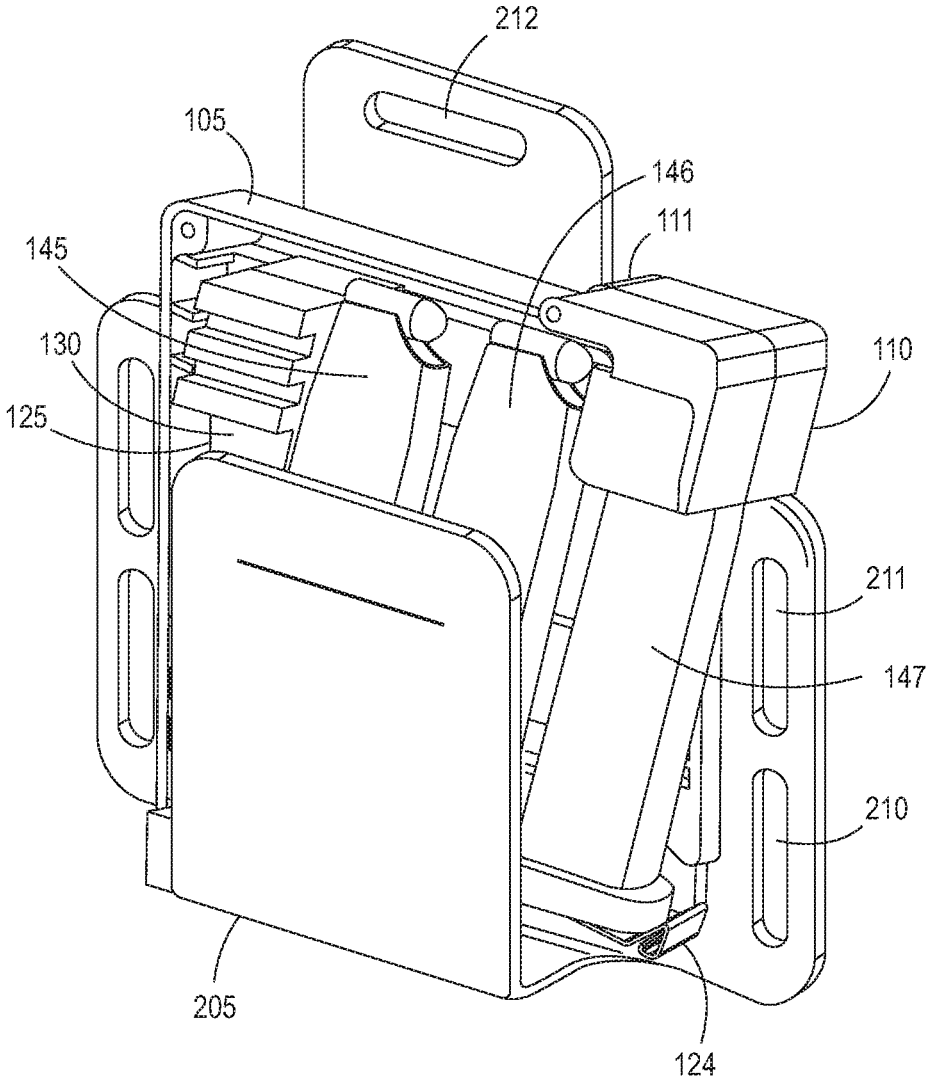
FIG. 8 is a cut away view of a magazine dispenser inserted in a holster with a cap closed.
Figure 9:
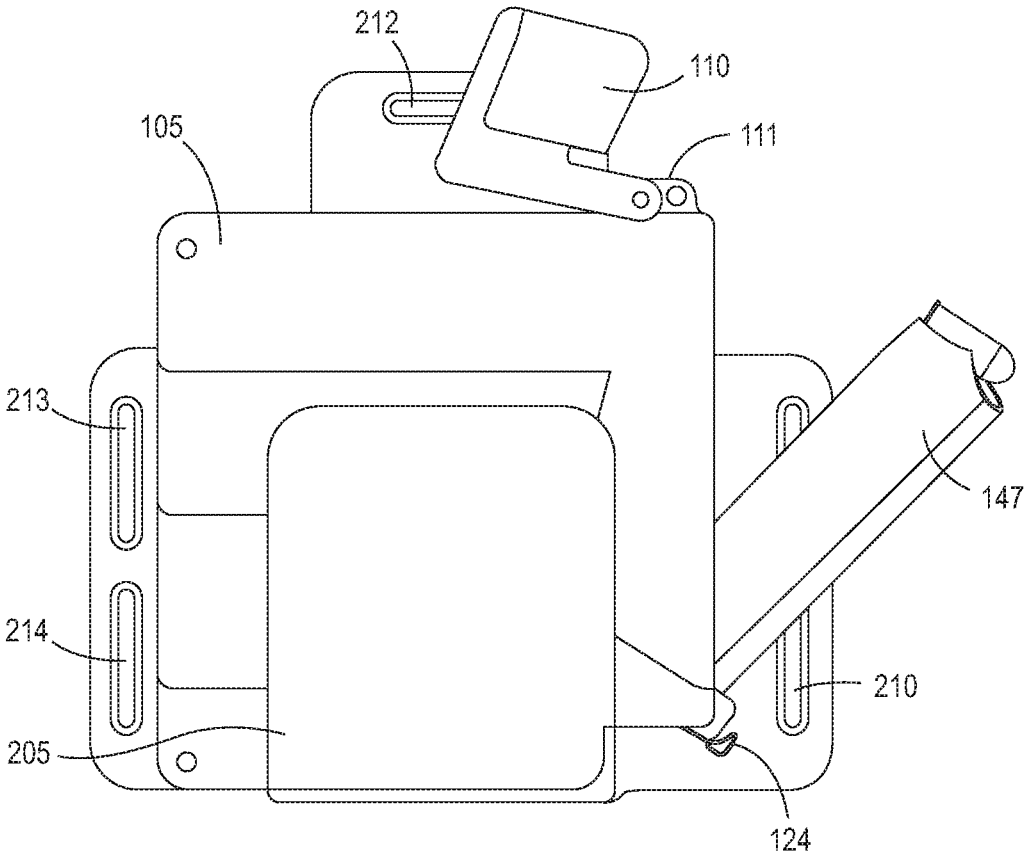
FIG. 9 is a side view of a magazine dispenser inserted in a holster with a cap opened.

Referring to FIGS. 5 and 6, the magazine dispenser may further include holster 205. As shown in FIG. 7, holster 205 may be configured to hold housing 105 and be secured to another object with strap 215. Holster 205 may include a plurality attachment holes 210-214 configured to receive strap 215 and be tightly secured to another object. For example, housing 105 may be inserted in holster 205 and be secured to wearer's leg 405 with strap 215. Strap 215 may go into one of attachment holes 210 and wrap around wearer's leg 405 to reach another attachment hole 214 in order to tightly secure holster 205 to wearer's leg 405. Referring to FIG. 8 and FIG. 9, holster 205 may be configured to not interfere with magazines being inserted or dispensed from housing 105.

As shown in FIG. 1, slot region 115 may be disposed in housing 105 and provide a track for magazines being inserted into housing 105. The track may be configured to receive a flange of a magazine. For example, a flange of the magazine may be held in the track when the magazine is inserted through the opening of housing 105.

Retention bar 120 may be disposed in the track provided by slot region 115 to bias the magazines inserted in housing 105. As shown in FIG. 2, when a magazine is inserted into housing 105, the magazine may rest on retention bar 120 and be biased according to a shape of retention bar 120. In accordance with at least one embodiment, slot region 115 may have a shape which corresponds to a shape of retention bar 120. For example, retention bar 120 may be bent to bias the magazines inserted in housing 105 at a particular angle. Then, slot region 115 may have a shape that corresponds to the bent-shape of retention bar 120. This may ensure that a flange of the magazine is tightly held regardless whether the magazine rests on either a straight or bent portion of retention bar 120.

As shown in FIG. 1, retention bar 120 may include straight portion 121, first bent portion 122, second bent portion 123, and lip portion 124. First bent portion 122 may be bent substantially perpendicular to straight portion 121. Second bent portion 123 may be bent at an acute angle with respect to first bent portion 122. For example, retention bar 120 may be a straight bar having a step and a ramp. The step may be formed by firstly bending retention bar 120 substantially perpendicular to its longitudinal axis. The ramp may be formed by secondly bending an already bent portion of retention bar 120 to an acute angle with respect to the bent portion.

As shown in FIG. 2, the magazines inserted in housing 105 may rest on retention bar 120. In accordance with at least one embodiment, housing 105 may hold three magazines. For example, first magazine 145 and second magazine 146 may be the first two magazines that are inserted in housing 105 and may rest on straight portion 121. Third magazine 147 may be a last magazine that is inserted in housing 105 and may rest on second bent portion 123. As shown in FIG. 2, first bent portion 122 may hold first two magazines, first magazine 145 and second magazine 146, from moving onto second bent portion 123, and lip portion 124 may hold a last inserted magazine, third magazine 147, from slipping out of housing 105.

Figure 10A:
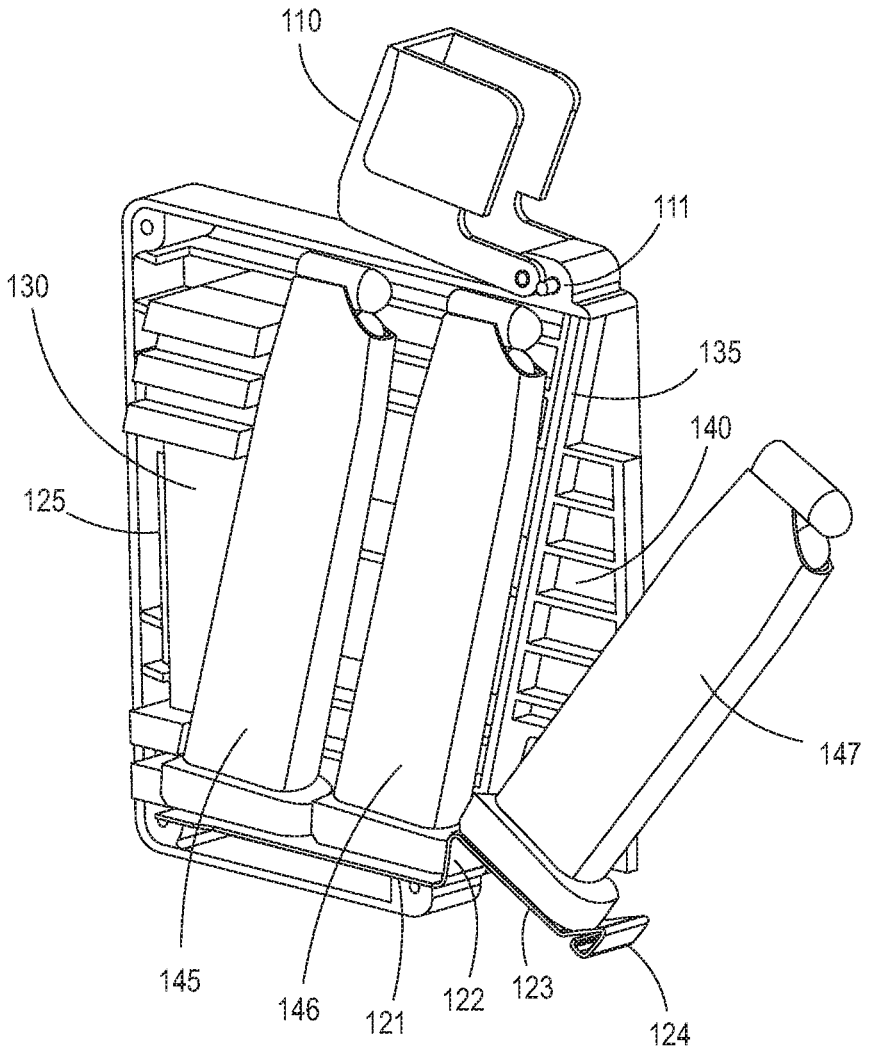
FIGS. 10A, 10B, and 10C illustrate a magazine being dispensed from a magazine dispenser.

As shown in FIG. 2, a magazine may be inserted into housing 105 in a direction which allows the magazine to be easily loaded into a gun when the magazine is dispensed from housing 105. A surface of the magazine that is being inserted through the opening of housing 105 may come into a contact with plunger 130. As shown in FIG. 10A, plunger 130 may be disposed in housing 105 and be coupled to spring 125. As shown in FIG. 10A, spring 125 may have first and second ends and be disposed between plunger 130 and an interior of housing 105. The first end of spring 125 may be coupled to plunger 130 and the second end of spring 125 may be coupled to the interior of housing 105.

As shown in FIG. 10A, plunger 130 may further have a wedge-like shape that corresponds to a shape of a magazine. For example, a surface of the magazine being inserted through the opening of housing 105 may come into contact with a surface of plunger 130. Then, a force being exerted on plunger 130 by the magazine or a force being exerted on the magazine by plunger 130 may be distributed and transferred over an area in contact. A more stable distribution or transfer of the force may occur when the area in contact is large. Accordingly, plunger 130 may have a wedge-like shape that corresponds to a shape of a magazine to increase the area in contact.

Figure 10B:
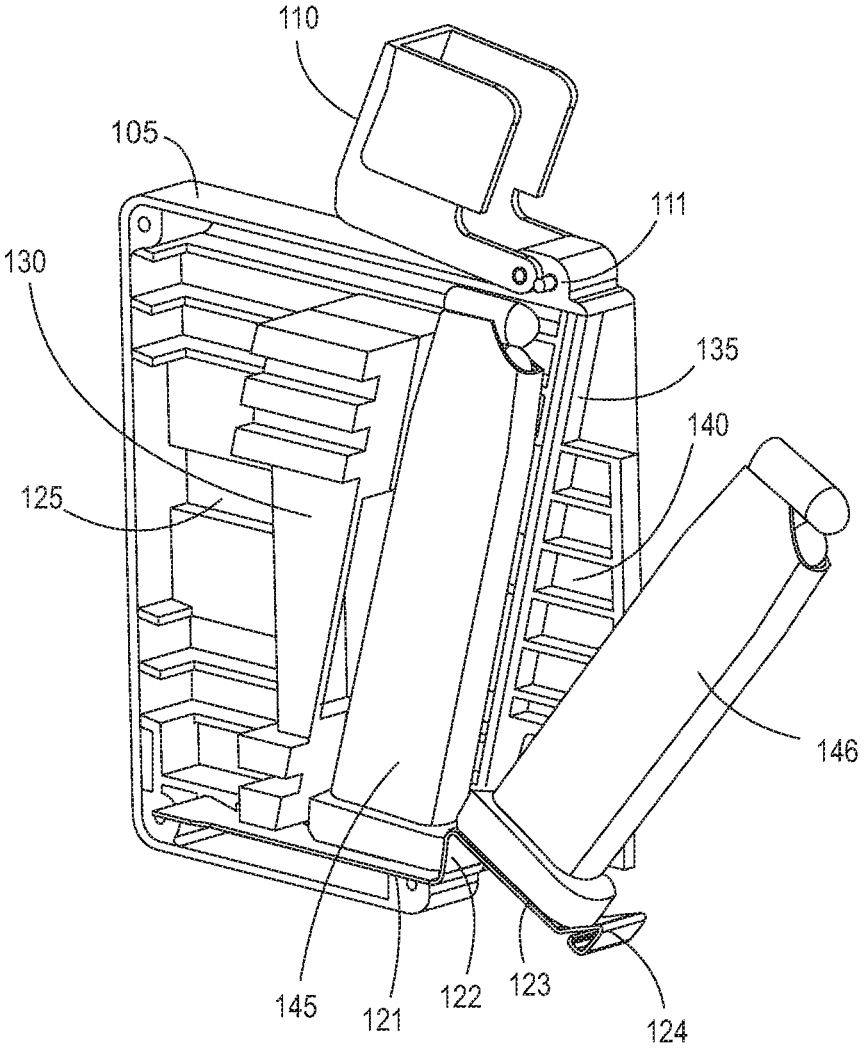
Figure 10C:
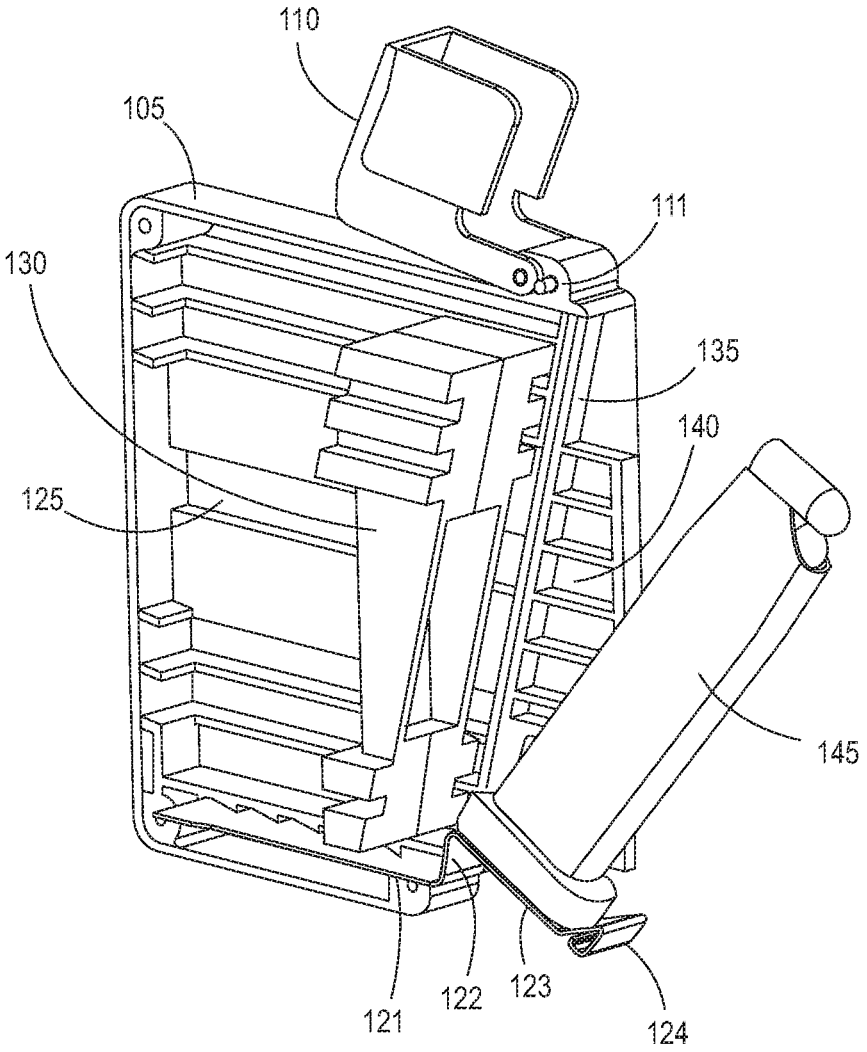

When there is only one magazine inserted in housing 105, that magazine may not come into contact with plunger 130. As shown in FIG. 10C, a magazine may reset on second bent portion 123, when there is only one magazine present in housing 105. As another magazine is inserted through the opening of housing 105, the magazine resting on second bent portion 123 may be pushed inwardly away from the opening as another magazine takes its place. The magazine may then come into contact with plunger 130. As the magazine gets pushed towards the inside of housing 105 by another magazine taking its place, the magazine may push plunger 130 away from the opening, towards the inside of housing 105 as well.

As shown in FIG. 10A, first magazine 145 may be pushed inwardly by second magazine 145, and second magazine 146 may be pushed inwardly by third magazine 147. A last inserted magazine, third magazine 147, may rest on second bent portion 123, and first two magazines 145, 146 may rest on straight portion 121. Spring 125 may be compressed and exert a tensile force against plunger 130 which is in contact with first magazine 145. First bent portion 122, however, may hold first two magazines 145, 146 from being pushed outwardly towards the opening of housing 105 by the tensile force.

Figure 11:
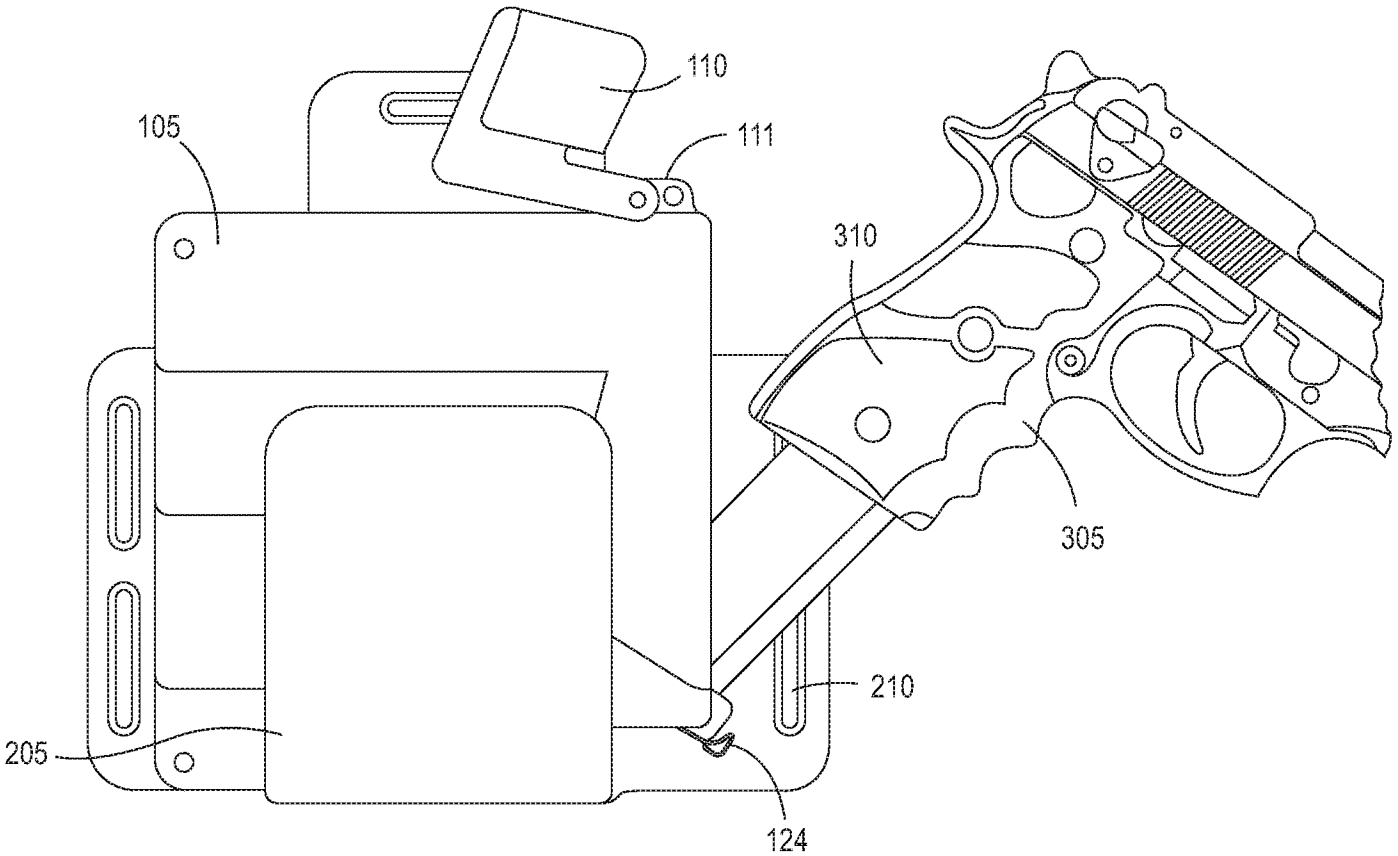
FIG. 11 illustrates a magazine being dispensed and loaded into a gun.

Thus, once spring 125 is compressed and plunger 130 is pushed inwardly, spring 125 and plunger 130 may remain still until a force is exerted on retention bar 120 to dispense a magazine resting on second bent portion 123. As shown in FIG. 11, gun 305 having magazine chamber 310 may be used to dispense a last inserted magazine, third magazine 147, resting on second bent portion 123. Once a top of third magazine 147 resting on second bent portion 123 is placed in magazine chamber 310 of gun 305, gun 305 may exert a force on retention bar 120 to have magazine 147 dispensed. Retention bar 120 may be depressed by the force and thus be flexed to allow second magazine 146 to move onto second bent portion 123, once third magazine 147 is dispensed and loaded into gun 305.

More specifically, when third magazine 147 is dispensed from housing 105 by a force exerted on retention bar 120, first bent portion 122 is flexed to allow second magazine 146 to take a place of third magazine 147. First bent portion 122 normally prevents first and second magazines 145, 146 from being pushed outwardly when it is not flexed. When first bent portion 122 is flexed, a tensile force exerted by spring 125 and plunger 130 moving outwardly due to the tensile force, pushes second magazine 146 outwardly towards the opening of housing 105 to be rested on second bent portion 123 of retention bar 120, as shown in FIG. 10B. When second magazine is dispensed from housing 105 by another force exerted on retention bar 120, first magazine 145 takes places of second magazine 146 accordingly, as shown in FIG. 10C.

Alternatively, when second magazine 146 is inserted in housing 105 after first magazine 145, first magazine 145 may push plunger 130 inwardly away from the opening of housing 105 and may compress spring 125. First magazine 145 then may rest on straight portion 121 and second magazine 146 may rest on second bent portion 123. First magazine 145 may be secured from being dispensed by first bent portion 122, unless a force is exerted to dispense second magazine 146. When the force is exerted on retention bar 120, second magazine 146 is released from second bent portion 123, and first bent portion 122 may be flexed to allow first magazine 145 to move outwardly towards the opening of housing 105. Specifically, spring 125 may exert a tensile force against plunger 130 to push first magazine 145 outwardly towards the opening of housing 105.

In accordance with at least one embodiment, the magazine dispenser may include housing 105 containing three magazines. For example, first and second magazines 145, 146 may rest on straight portion 121 and may be secured by first bent portion 122 from being pushed outwardly towards the opening of housing 105 by spring 125. Third magazine 147 may rest on second bent portion 123 and may be secured by lip portion 124, grooves 140 and closed cap 110 from being dispensed. Third magazine 147, when resting on second bent portion 123, may be resting at an angle corresponding to the angle at which second bent portion 123 is bent with respect to first bent portion 122. A top of third magazine 147 may thus protrude through the opening of housing 105, and cap 110 may be configured to cover the top of the third magazine when closed.

Although embodiments of the present disclosure have been described herein, it should be understood that the foregoing embodiments are merely examples and are not to be construed as limiting the present disclosure or the scope of the claims. Numerous other modifications and embodiments can be devised by those skilled in the art that will fall within the spirit and scope of the principles of this disclosure, and the present teaching can also be readily applied to other types of apparatuses. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments.

In addition, it should be understood that the figures and algorithms, which highlight the functionality and advantages of the present disclosure, are presented for example purposes only. The architecture of the present disclosure is sufficiently flexible and configurable, such that it may be utilized in ways other than that shown in the accompanying figures and algorithms.

It should be noted the terms "including" and "comprising" should be interpreted as meaning "including, but not limited to."

In the specification, "a" and "an" and similar phrases are to be interpreted as "at least one" and "one or more." References to "the, "said," and similar phrases should be interpreted as "the at least one", "said at least one," etc. References to "an" embodiment in this disclosure are not necessarily to the same embodiment.

It is the applicant's intent that only claims that include the express language "means for" or "step for" be interpreted under 35 U.S.C. §112, paragraph 6. Claims that do not expressly include the phrase "means for" or "step for" are not to be interpreted under 35 U.S.C. §112, paragraph 6.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

Further, the purpose of the Abstract of the Disclosure is to enable the U.S. Patent and Trademark Office and public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

I claim:

1. An ammunition magazine dispenser comprising:

a) a housing comprising opposed first and second side walls joined to a bottom wall, each of the first and second side walls and bottom wall including a perimeter edge wherein the perimeter edges of the walls define an opening of the housing, the first sidewall defining a lateral plane parallel to a direction of dispensation; and b) a first magazine comprised of an elongated hollow body including a closed distal end disposed upon the bottom wall of the housing, parallel first and second body side walls extending outwardly through the opening of the housing, and an open proximal end operable to present at least one ammunition cartridge for loading in a weapon, the ammunition cartridge having a central axis aligned parallel to the first and second body side walls and in the direction of dispensation.

2. The ammunition magazine dispenser of claim 1, wherein when the dispenser is attached to a leg portion of a human user with upper portions of the perimeter edges of the first and second side walls of the housing proximate to a hip region of the human user, the first magazine is positioned such that the open proximal end of the hollow body of the first magazine is proximate to the hip region of the human user.

3. The ammunition magazine dispenser of claim 1, wherein the dispenser is attachable to a leg portion of a human user, the leg portion having a longitudinal axis defined as extending downwardly from a hip region of the human user, wherein when the housing of the dispenser is attached to the human user with upper portions of the perimeter edges of the first and second side walls transverse to the longitudinal axis, the first magazine is positioned such that the open proximal end of the hollow body of the first magazine extends transversely to the longitudinal axis.

4. The ammunition magazine dispenser of claim 1, wherein the dispenser is attached to a holster joinable to a body of a human user, the body having a longitudinal axis defined as extending downwardly from a hip region along a leg portion of the human user, wherein when the housing of the dispenser is attached to the holster relative to the body of the human user with upper portions of the perimeter edges of the first and second side walls transverse to the longitudinal axis, the first magazine is positioned such that the open proximal end of the hollow body of the first magazine extends transversely to the longitudinal axis.

5. The ammunition magazine dispenser of claim 1, wherein the distal end of the first magazine is comprised of a base flange removably engaged with the first and second side walls of the housing.

6. The ammunition magazine dispenser of claim 1, wherein the perimeter edges of the first and second walls are front edges defining a front opening of the housing.

7. The ammunition magazine dispenser of claim 6, further comprising a top wall joined to upper edges of the first and second side walls, and comprising a front edge forming a portion of the front opening of the housing.

8. The ammunition magazine dispenser of claim 1, wherein the first and second opposed side walls include elongated opposed slots proximate to the bottom wall and extending in a direction along the bottom wall toward the opening, and wherein a base flange of the first magazine includes a first protruding flange edge slidably engaged with the elongated slot of the first side wall, and a second protruding flange edge slidably engaged with the elongated slot of the second side wall.

9. The ammunition magazine dispenser of claim 1, further comprising a back wall joined to rear edges of the first and second side walls of the housing, and a second magazine contained within the housing between the back wall and the first magazine, and including a distal end disposed upon the bottom wall.

10. An ammunition magazine dispenser comprising:

a) a housing comprising opposed first and second side walls joined to a bottom wall, each of the first and second side walls and bottom wall including a perimeter edge wherein the perimeter edges of the walls define an opening of the housing;

b) a first magazine comprised of an elongated hollow body including a closed distal end disposed upon the bottom wall of the housing, a body side wall extending outwardly through the opening of the housing, and an open proximal end operable to present at least one ammunition cartridge for loading in a weapon; and c) an elongated bar disposed between the opposed first and second side walls and comprising a base section proximate to the bottom wall, a step section formed between a first bend at an end of the base section and a second bend; and a ramp section extending from the second bend out the opening of the housing and terminating at a lip.

11. The ammunition magazine dispenser of claim 10, wherein the elongated bar is formed of an elastic material, and wherein application of a force perpendicular to the ramp section of the elongated bar causes downward displacement of the ramp section relative to the housing from a free position to a stressed position, and wherein removal of the force causes restoration of the ramp section to the free position.

12. The ammunition magazine dispenser of claim 10, wherein the closed distal end of the first magazine is disposed upon the ramp section of the elongated bar, and the dispenser further comprises a back wall joined to rear edges of the first and second side walls of the housing, and a second magazine contained within the housing between the back wall and the first magazine, and including a closed distal end disposed upon the base section of the elongated bar.

13. The ammunition magazine dispenser of claim 12, wherein the elongated bar is formed of an elastic material, and wherein application of a force on the first magazine and perpendicular to the ramp section of the elongated bar causes downward displacement of the ramp section relative to the housing from a free position to a stressed position, and wherein removal of the force and the first magazine from the ramp section of the elongated bar causes restoration of the ramp section to the free position.

14. The ammunition magazine dispenser of claim 13, wherein the removal of the first magazine from the ramp section of the elongated bar permits the movement of the second magazine over the step section and onto the ramp section of the elongated bar.

15. The ammunition magazine dispenser of claim 12, further comprising a plunger member disposed between the second magazine and the back wall of the housing and slidable between the first and second side walls of the housing, and a spring disposed between the back wall of the housing and the plunger member and applying a displacement force against the plunger member and the second magazine.

16. An ammunition magazine dispenser comprising:

a) a housing comprising opposed first and second side walls joined to a bottom wall, each of the first and second side walls and bottom wall including a front perimeter edge wherein the front perimeter edges of the walls define an opening of the housing; and b) a first magazine comprised of an elongated hollow body including a closed distal end disposed upon the bottom wall of the housing, a body side wall extending outwardly through the opening of the housing, and an open proximal end operable to present at least one ammunition cartridge for loading in a weapon, wherein an upper portion of the body side wall of the first magazine extends forwardly at an acute angle beyond the front perimeter edges of the first and second side walls of the housing.

17. The ammunition magazine dispenser of claim 16, wherein when the dispenser is attachable to a leg portion of a human user with upper portions of the perimeter edges of the first and second side walls of the housing proximate to a hip region of the human user, the first magazine is positioned such that the open proximal end of the hollow body of the first magazine is proximate to the hip region of the human user.

18. The ammunition magazine dispenser of claim 16, wherein the dispenser is attachable to a leg portion of a human user, the leg portion having a longitudinal axis defined as extending downwardly from a hip region of the human user, wherein when the housing of the dispenser is attached to the human user with upper portions of the perimeter edges of the first and second side walls transverse to the longitudinal axis, the first magazine is positioned such that the open proximal end of the hollow body of the first magazine extends transversely to the longitudinal axis.

19. The ammunition magazine dispenser of claim 16, wherein the dispenser is attached to a holster joinable to a body of a human user, the body having a longitudinal axis defined as extending downwardly from a hip region along a leg portion of the human user, wherein when the housing of the dispenser is attached to the holster relative to the body of the human user with upper portions of the perimeter edges of the first and second side walls transverse to the longitudinal axis, the first magazine is positioned such that the open proximal end of the hollow body of the first magazine extends transversely to the longitudinal axis.

* * * * *